US005193463A

United States Patent [19]

Kunczynski

[11] Patent Number: 5,193,463

[45] Date of Patent: Mar. 16, 1993

[54] ROPE TOW APPARATUS AND METHOD

[75] Inventor: Jan K. Kunczynski, Glenbrook, Nev.

[73] Assignee: Zygmunt Alexander Kunczynski and Alexander Jan Kunczynski, Carson City, Nev.

[21] Appl. No.: 866,457

[22] Filed: Apr. 10, 1992

[51] Int. Cl.[5] ..... B61B 11/00

[52] U.S. Cl. ..... 104/173.2; 104/173.1

[58] Field of Search ..... 104/112, 114, 115, 173.1, 104/173.2, 176, 177, 178, 180, 181, 182, 196, 202, 193, 192

[56] References Cited

FOREIGN PATENT DOCUMENTS

| | | | |
|---|---|---|---|
| 2501444 | 7/1976 | Fed. Rep. of Germany | 104/202 |
| 0817506 | 9/1937 | France | 104/173.2 |
| 2273699 | 1/1976 | France | 104/202 |
| 0094347 | 1/1939 | Sweden | 104/173.2 |

*Primary Examiner*—Mark T. Le
*Attorney, Agent, or Firm*—Flehr, Hohbach, Test, Albritton & Herbert

[57] ABSTRACT

A rope tow system including a haul rope (23, 23*a*) extending along a path, haul rope mounting assembly (21, 22) mounting the haul rope (23, 23*a*) for movement in spaced relation above the tow path. Haul rope driving assembly (31, 32) is coupled to the haul rope for advancement thereof, and a plurality of hanger arms (42, 42*a*) are coupled to the haul rope and depend downwardly therefrom. Each hanger arm (42, 42*a*) is mounted to the haul rope (23, 23*a*) by a mounting assembly (43, 43*a*) substantially preventing rearward deflection of the hanger arms (42, 42*a*) relative to the haul rope (23, 23*a*). Finally, a user-grippable tow rope (41, 41*a*) is coupled to each of the hanger arms (42, 42*a*) for movement therewith. The tow rope (41, 41*a*) is secured to the hanger arms (42, 42*a*) in positions below the haul rope (23, 23*a*) and at a height above the snow surface (29) suitable for gripping by skiers while being towed along the tow path. A method of providing a tow rope system and a method of supporting a tow rope for advancement in the system.

21 Claims, 5 Drawing Sheets

ROPE TOW APPARATUS AND METHOD

TECHNICAL FIELD

The present invention relates, in general, to conveying apparatus of the type used to transport skiers, and more particularly, relates to rope tow apparatus used to pull or tow skiers along a tow path while their skis are in contact with the snow.

BACKGROUND ART

Rope tow systems have been employed in the skiing industry for many years. They are particularly well suited for moving skiers up slopes of moderate pitch and/or moving skiers over near horizontal expanses of snow. Rope tows are surface conveyancing systems in which the skier's skis are in contact with the snow as he or she is towed or pulled by a rope or cable along the tow path.

Prior art rope tows generally have been constructed by employing an endless loop rope that is mounted at opposed ends to sheaves, pulleys or bull wheels. One end of the rope is engaged by a drive sheave that frictionally drives the tow rope, while the other end typically is supported by an idler wheel. The tow rope itself usually is a fiber rope which can be gripped anywhere along its length by the skiers. In some instances, a cable is employed with handles or grips secured to the cable.

One of the major advantages of a rope tow surface lift system is that it is relatively low in cost for a ski area to install. Additionally, it can provide reasonably high capacity for beginner slopes. Rope tows, however, have been found to have numerous disadvantages.

Characteristically, the tow rope is not under very much tension and, in fact, drags in the snow when not gripped and held by skiers. Thus, icing of the rope is a constant problem. Moreover, as the number of skiers gripping the rope increases the tension force in the rope cumulates at the uphill or first skier's position. Thus, when twenty skiers, for example, grip the tow rope, gripping of the high-tension, uphill portion of the rope becomes more difficult and relatively uncomfortable for the uphill skiers. As the length of the rope tow increases, therefore, the number of skiers using the tow tends to increase and the comfort level during gripping of the rope decreases.

One of the disadvantages of a rope tow, however, is the lack of safety. While rope tows may seem to be inherently safe, each year there are numerous serious injuries occurring as a result of the use of rope tows. The primary cause of such accidents is twisting of the rope as it is being advanced. As the rope twists, skiers' scarves, clothing and even hair can become wrapped or entangled around the twisting rope. The skier may not be aware that this is occurring, and when he or she lets go of the rope, they find that they are hopelessly entangled or attached to the rope. The skier can be pulled through, around or under the rope tow safety gate and into the uphill terminal sheave or bull wheel or its support structure, with catastrophic results.

There also is a continuing need in ski resorts for conveyancing of a high volume of skiers over relatively flat terrain at modest cost. Thus, remote parking areas, condominium projects, lodges and restaurants at the base of a ski resort, and similar lodges, restaurants and other facilities on the mountain, often require the skier to walk substantial distances in ski boots with skis carried on their shoulders. Various solutions, such as shuttle buses and chairlifts, have been employed, but often they are undesirably expensive or have limitations as to the length over which they are practical.

A rope tow system would provide a good solution to this type of skier transport problem if the safety and comfort disadvantages of prior rope tows could be overcome.

Accordingly, it is an object of the present invention to provide a rope tow apparatus and method having improved safety and greater comfort in its use to provide greatly enhanced application in the conveying of skiers.

A further object of the present invention is to provide a rope tow system which is inexpensive to construct, durable, and suitable for use by novice skiers.

The rope tow apparatus and method of the present invention have other objects and features of advantage which will become apparent from, and are set forth in more detail in, the following description of the Best Mode of Carrying out the Invention and the accompanying drawing.

DESCRIPTION OF THE INVENTION

The rope tow of the present invention is comprised, briefly, of a haul rope which extends along a tow path, haul rope mounting assembly mounting the haul rope for movement in spaced relation above the tow path, haul rope driving assembly coupled to the haul rope for advancement of the haul rope, and a plurality of hanger arms coupled to the haul rope and depending downwardly therefrom. Each of the hanger arms is coupled by hanger arm mounting assembly formed to substantially prevent deflection of the hanger arms relative to the haul rope in a rearward direction. The rope tow system further includes a user-grippable tow rope coupled to each of the hanger arms for movement therewith at positions below the haul rope. Preferably, the haul rope is an endless loop and the hanger arms are rigidly coupled to the haul rope against deflection in both the fore and aft directions while also being coupled to the haul rope in a manner enabling passage of the hanger arm mounting assembly around the bull wheels.

The method of supporting a tow rope in a rope tow conveying assembly of the present invention is comprised, briefly, of the steps of mounting a plurality of hanger arms to a haul rope supported for movement along a tow path with the mounting step being accomplished by relatively rigidly securing the hanger arms to the haul rope against substantial deflection in an aft direction relative to the haul rope, and coupling a user-grippable tow rope to the hanger arms at positions below the haul rope.

BEST MODE OF CARRYING OUT THE INVENTION

The rope tow system of the present invention is unlike conventional rope tow systems in which a single endless loop tow rope is conveyed between end terminals. In the present rope tow system, two ropes are employed, namely, a haul rope, preferably under high tension, and a slack or relatively low-tension, user-grippable tow rope.

Figure 1:
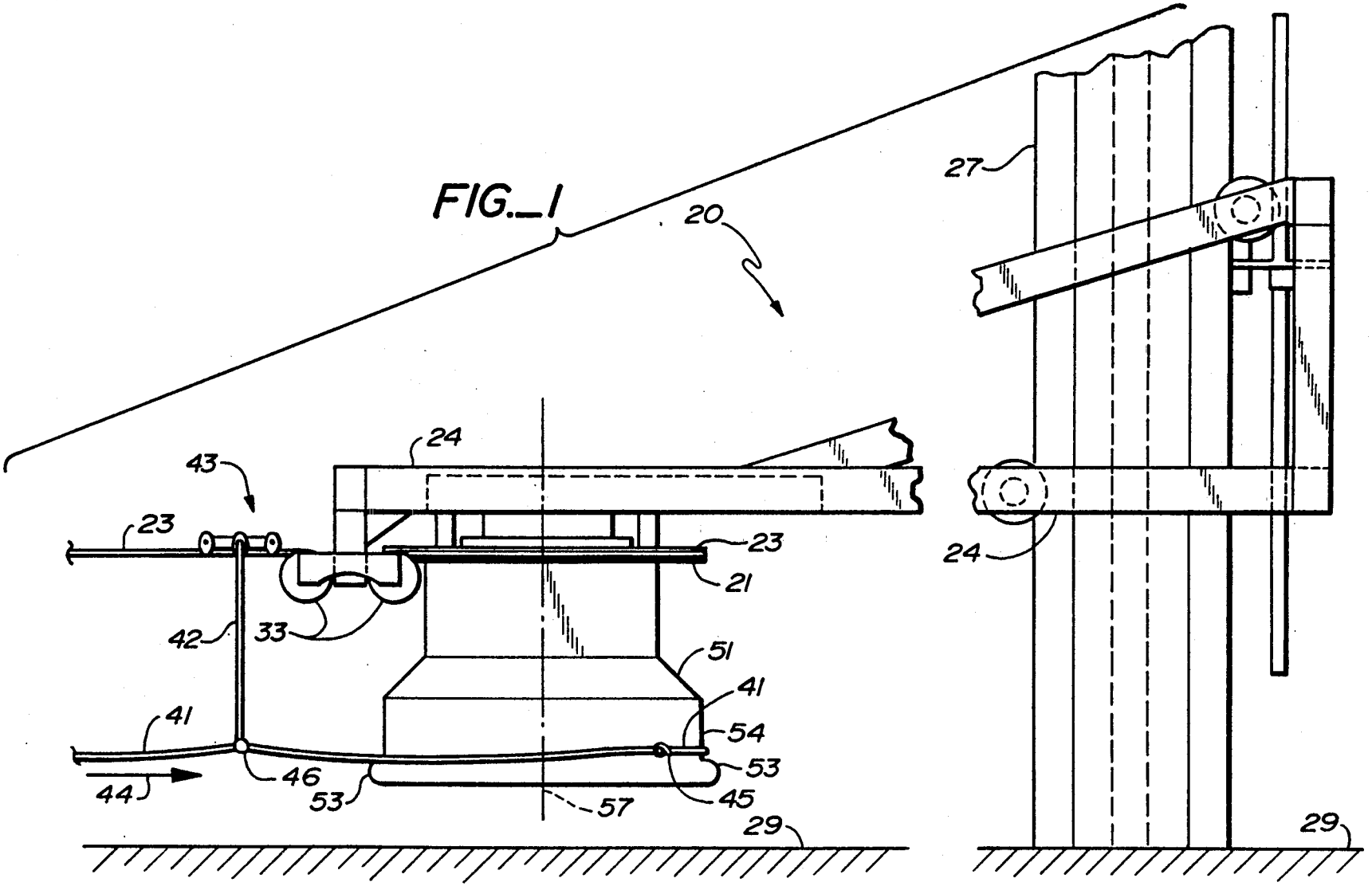
FIG. 1 is a fragmentary, side elevation view of an idler end terminal of a rope tow system constructed in accordance with the present invention.
Figure 2:
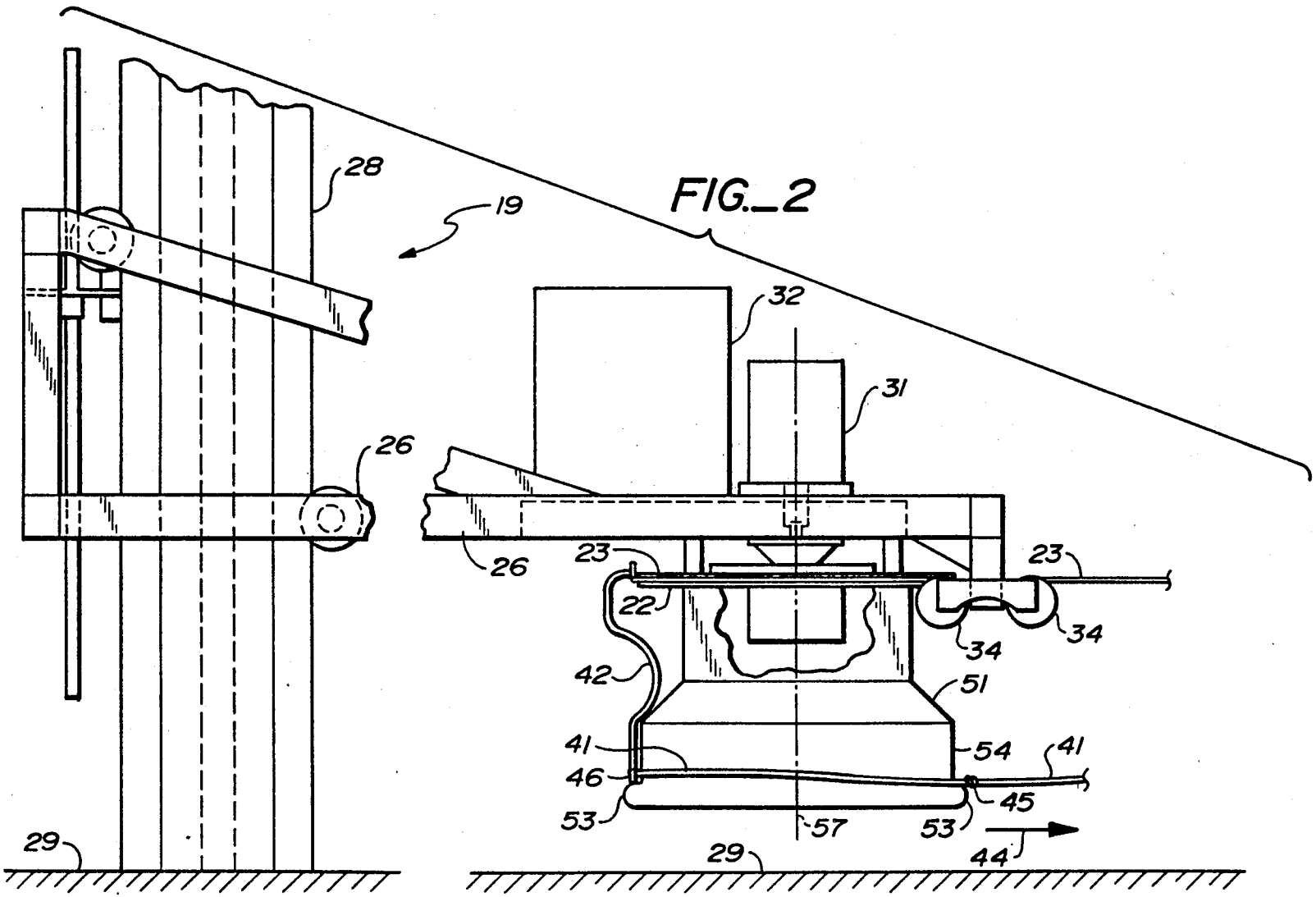
FIG. 2 is a fragmentary, side elevation view of a drive end terminal of the rope tow system of the present invention.

An idler end terminal, generally designated 20 and shown in FIG. 1, and a drive end terminal, generally designated 19 and shown in FIG. 2, are positioned at opposite ends of a tow path over which the rope tow is to be advanced. Extending between end terminals 19 and 20 is a loop-type haul rope 23, which is mounted to an idler bull wheel 21 and a similar drive bull wheel 22. As shown in the drawing, bull wheels 21 and 22 are near or substantially horizontally oriented, but such an orientation of the bull wheels is not required for the present rope tow system. Bull wheels 21 and 22 are rotatably mounted to frame members 24 and 26, respectively, which, in turn, are mounted to vertical support towers, namely, towers 27 and 28. Bull wheels 21 and 22 may be vertically adjustable along towers 27 and 28 to accommodate various heights of snow surface 29. The height adjustment of bull wheels 21 and 22, as well as their rotatable mounting, is well known in the skiing industry and does not form a novel portion of the tow rope system of the present invention.

As will be seen from FIG. 2, terminal 19 also includes a motor 31 which is coupled to drive bull wheel 22 and a power and control assembly housing 32 in which the various power and motor control apparatus are housed. Also mounted to the end of the terminal frame members 26 and 24 are guide sheave assemblies 33 and 34 which guide the entrance and exit of haul rope 23 onto and off of bull wheels 21 and 22.

In the present invention, it is preferred that haul rope 23 be provided by a steel cable, that is, a haul rope of the type used in chairlifts, gondolas and other aerial tramways. The respective positions of bull wheels 21 and 22 can be adjusted along frame members 24 and 26 so as to place haul rope 23 under substantial axial tension, and haul rope 23 will be positioned in an elevated position over snow surface 29 over the entire length of the tow path between end terminals 19 and 20.

As the above indicated, the rope tow system of the present invention includes a second rope, namely, tow rope 41. Tow rope 41 similarly extends along the tow path between the two end terminals, but at a position below haul rope 23, for example, about 4 to 8 feet below haul rope 23. Moreover, tow rope 41 is not directly driven by bull wheels 21 and 22, but instead is coupled to haul rope 23 by a plurality of hanger arms 42. Hanger arms 42 are positioned in spaced relation along the length of haul rope 23, for example, at about 30 to about 50 foot intervals, and the hanger arms are mounted thereto by hanger arm mounting means, generally designated 43.

It is an important feature of the present invention that the hanger arm mounting means or assemblies 43 couple the hanger arms to haul rope 23 in a manner substantially preventing deflection of the hanger arms relative to the haul rope at least in an aft direction and, preferably, in both a fore and aft direction along haul rope 23. Thus, if haul rope 23 is being advanced in the direction of arrows 44 in FIGS. 1 and 2, mounting means 43 relatively rigidly couples hanger arm 42 to the haul rope against deflection along the haul rope in a direction opposed to arrows 44.

As can be seen from FIGS. 1 and 2, user-grippable tow rope 41 is also coupled to each of hanger arms 42, for example at coupling 46, for movement with the hanger arms below the haul rope as the haul rope is advanced along the tow path. Coupling 46 preferably firmly grips or holds the tow rope so that it cannot slip relative to each hanger arm. Tow rope 41 preferably is a fiber or nylon rope, rather than a steel cable, so that it can be more easily and comfortably gripped by skiers. Additionally, haul rope 41 preferably has a length between hanger arms 42 which results in the tow rope being slack or under relatively little tension between the adjacent hanger arms.

In the conventional rope tow, the tow rope is both free to twist and, when not held by skiers, contacts the snow surface. In the rope tow system of the present invention, the use of an elevated high-tension haul rope 23 allows tow rope 41 to be held out of contact with snow surface 29 over substantially the entire length of the tow path, while still permitting tow rope 41 to be under relatively low axial tension between hanger arms. When a skier grips tow rope 41 and is towed along snow surface 29, the frictional force of pulling the skier over the snow surface will be transmitted up the tow rope to the hanger arm, ahead of the skier and from there, through mounting assembly 43 to the high-tension haul rope. Some negligible aft deflection of the hanger rope will occur, but the tension force in the tow rope 41 will not be transmitted to a substantial degree to the section of haul rope in advance of each hanger arm 42. Thus, the tow rope tensioning effect produced by skier friction does not accumulate along the tow rope, and each segment of the tow rope will be under relatively low tension. This makes gripping of tow rope 41 much more comfortable than gripping of a conventional tow rope when many skiers are using the rope tow.

In a typical installation, hanger arms 42 have a length of 6 feet and are spaced apart by about 40 feet. Haul rope 23 will be under substantial tension, for example, 1,000 pounds of axial force, or more, and tow rope 41 between pairs of hanger arms will sag from a straight line by about 1 to 1 and ½ feet. As used herein, hanger arm mounting assembly 43 shall be considered to be constructed in a manner "substantially preventing deflection" if it is sufficiently resistant to rearward deflection of the hanger arms so that a skier gripping the tow rope between two hanger arms will not completely eliminate the slack or sag in the haul rope between the next or up-rope set of hanger arms. Thus, the skier will tension tow rope 41 from the position at which he grips the rope to the next up-rope hanger arm, which will deflect the lead hanger arm in the aft direction slightly, but not by an amount sufficient to remove the slack in the tow rope between the next, up-rope pair of hanger arms.

In the rope tow system of the present invention, it is a further feature that couplings 46 prevent twisting of tow rope 41, and haul rope 23 is under sufficient tension such that twisting of the haul rope cannot occur. Obviously, the downwardly-depending hanger arms 42 assist in resisting any tendency of haul rope 23 to twist as driven by the bull wheels.

As can be seen in FIGS. 1 and 2, each of end terminals 19 and 20 include a downwardly-depending tow rope support structure 51. Tow rope support structure 51 advantageously can be provided by a skirt-like construction having side walls which extend down below tow rope 41. A lip portion 53 keeps the relatively low-tension tow rope from falling down onto the snow surface 29. The diameter of lower cylindrical section 54 of the tow rope support structure is sufficiently small as to maintain the tow rope in a relatively untensioned condition.

As hanger arms 42 proceed around either the drive or idler bull wheels, support structures 51 maintain tow rope 41 in a generally parallel relationship to haul rope 23 without tensioning tow rope 41. In the most preferred form, lower cylindrical portion 54 of the tow rope support structures 51 can be covered with a resiliently compressible material, such as a natural or synthetic rubber, or rubber foam. The provision of a resiliently compressible material on support structure portion 54, and preferably lip 53, ensures that skier's hands will not be injured, should the skier hold onto tow rope 41 to the point at which haul rope 41 engages support structure 51, namely, a transverse plane 57 through the axis of the bull wheels. The skier's hand will be slightly squeezed, at worst, by the tow rope against the resiliently compressible support structure without injury. It is even possible for a skier to hold onto tow rope 41 and be towed completely around the bull wheel without injury. In the form of the invention shown in FIG. 7, the tow rope is held out of engagement with the support structure and the skier could grip the tow rope as it proceeds around the bull wheel without even touching the support skirt.

As will be seen from FIGS. 1 and 2, it is preferable that the frames 24 and 26, which support the bull wheels from the respective terminal towers 27 and 28, extend out a substantial distance from the towers so that there is little chance of the skier being propelled into the towers. As also will be seen in FIGS. 1 and 2, there is no structure between snow surface 29 and the tow rope supporting structure 51 that can be hit by the skier or the skier's equipment in the event that the skier should hold onto the tow rope. In the preferred form, however, a safety gate may be provided to shut down the tow rope in the event a skier held on too long and was being carried into the terminal bull wheel assembly.

Figure 4:
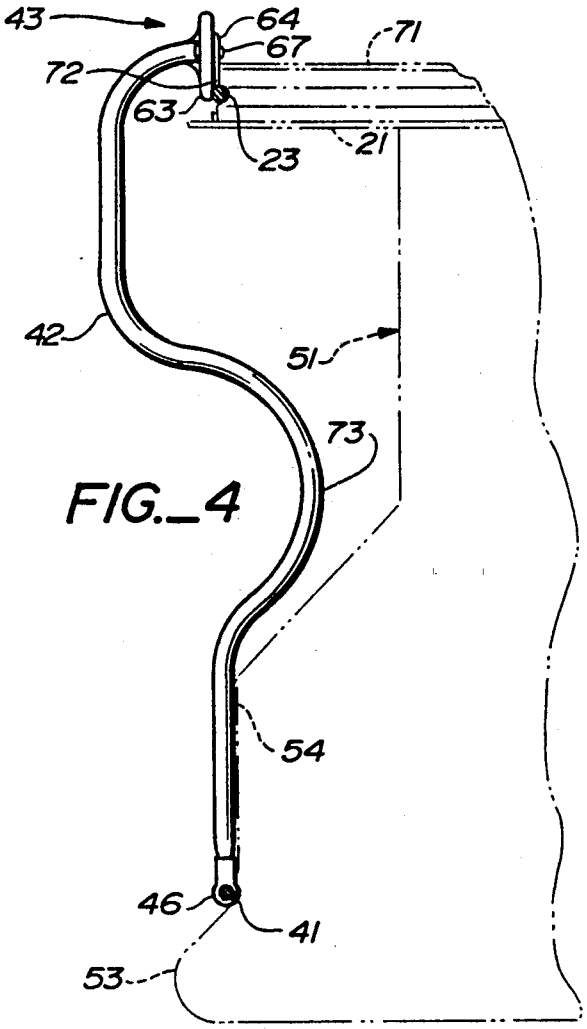
FIG. 4 is an end elevation view, corresponding to FIG. 3, showing the hanger arm, haul rope and tow rope and a bull wheel assembly in phantom lines.
Figure 3:
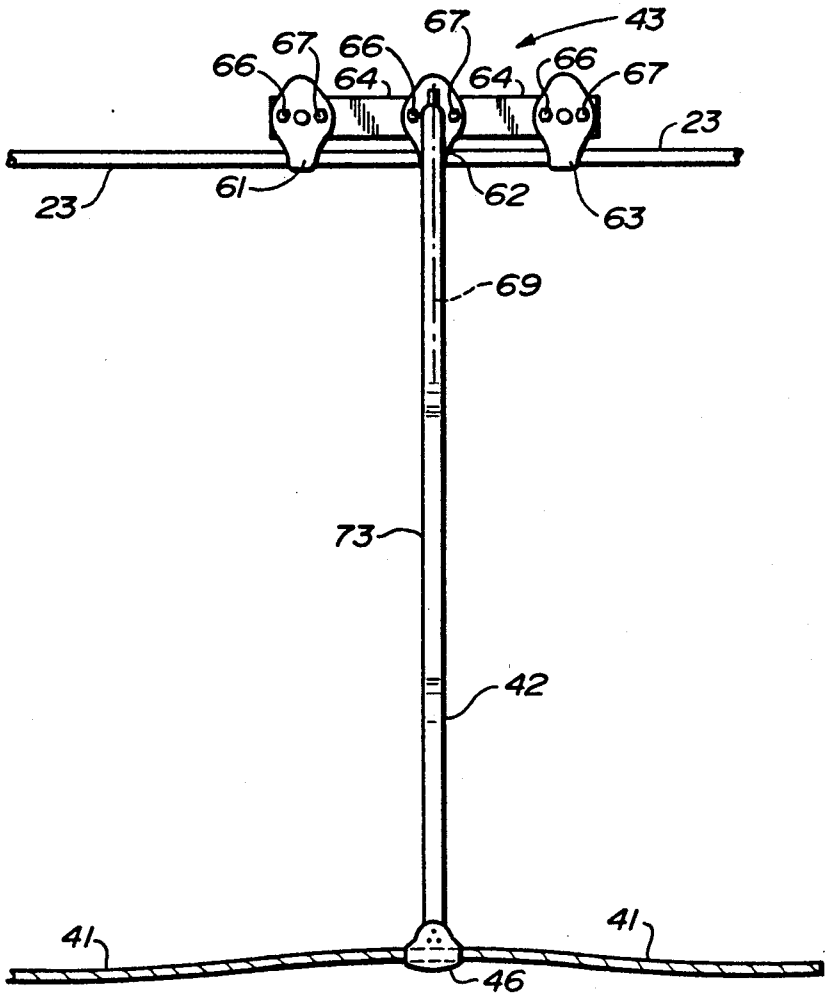
FIG. 3 is an enlarged, side elevation view of the haul rope, hanger arm and tow rope assembly of FIGS. 1 and 2.

Referring now to FIGS. 3 and 4, the details of construction of one hanger arm mounting assembly 43 can be set forth. As will be appreciated from the description above, hanger arm mounting assemblies 43 must be capable of resisting deflection of the hanger arms in an aft direction so as to avoid tension buildup in tow rope 41. Additionally, however, the hanger arm mounting assemblies 43 must also be capable of passing around bull wheels 21 and 22. Thus, hanger arm mounting assembly 43 is formed for bending or deflection laterally of haul rope 23, to enable passage around each of the bull wheels.

In the preferred form, mounting assembly 43 includes a plurality of haul rope gripping assemblies 61, 62 and 63, which assemblies grippingly engage haul rope 23 at spaced locations along the length of the haul rope. In order to further resist deflection of the hanger arms along the haul rope, extending between gripping assemblies 61–63 is a stiffening member 64. Stiffening member 64 can be coupled to grips 61–63, for example, by a pair of bolts 66 and 67. Stiffening member 64 advantageously can be provided as a relatively thin metal plate oriented with its thickness dimension substantially in a vertical plane through the haul rope so as to resist bending in the fore or aft directions about a transverse axis through plate 64. Plate 64, however, permits bending about a vertical axis 69 through the hanger arm 42 and therefore permits bending of the assembly 43 as it proceeds around the bull wheels. It will be apparent that other hanger arm mounting assemblies 43 will be effective in coupling the hanger arms against significant displacement along the haul rope.

As also will be seen from FIG. 4, the upper flange 71 of bull wheel 21 is essentially flush with rope guiding surface 72 of the bull wheel so that hanger arm mounting assembly 43 can pass around the bull wheel as stiffening member 64 bends or flexes laterally. The clamping or gripping jaws 61, 62 and 63 can be of a type well-known in the industry for gripping haul rope cables and stiffening member 64 provided by a steel plate 24 inches in length, ¼ to 3/16 inches thick and 4 inches high. Alternatively, stiffening member 64 can be provided by side-by-side thinner plates held together in a package.

Hanger arm mounting assembly 43, therefore, secures hanger arm 42 relatively rigidly to haul rope 23. Haul rope 23 can be of substantial diameter, for example, ¾ inches up to 2 inches, and under high tension so that displacement in aft direction will be minimal. This allows the tension force in the tow rope 41 to be transmitted through the hanger arms up to haul rope 43 without significantly increasing the tension upstream or in advance of a given hanger arm 42.

Mounting assembly 43 also minimizes forward hanger arm displacements so that skiers also can retard themselves on down-hill stretches without causing tow rope tension to build up undesirably. In rope tow installations in which down-hill section occur along the tow path, however, skiers may prefer to let go of the tow rope and ski to the next uphill section.

As also will be seen in FIG. 4, it is preferable that hanger arm 42 have an S-shaped upper section so that the hanger arm will hang naturally with tow rope 41 in substantial alignment with haul rope 23. Such hanger arm assemblies are broadly known in the skiing industry. When so-formed, the support structure 51 needs to have a stepped or recess configuration, as shown in FIG. 4, to accommodate inwardly-projecting middle portion 73 of the hanger arm.

Figure 6:
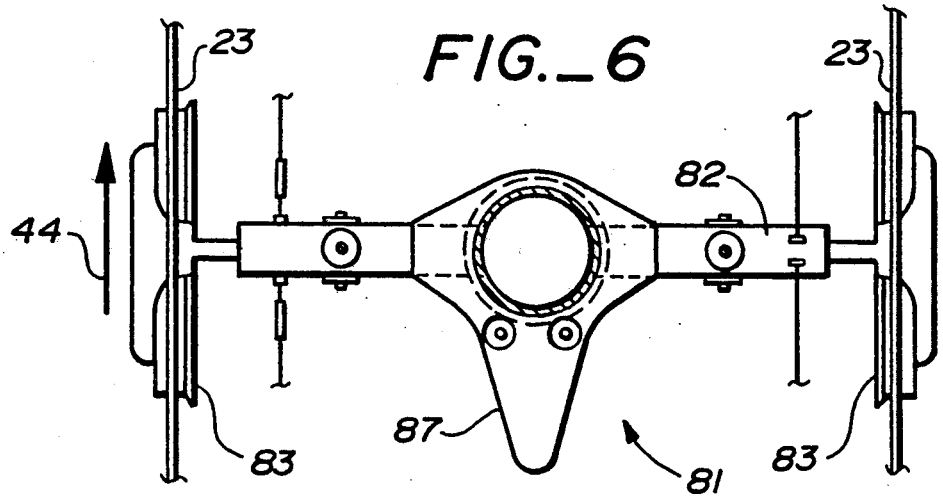
FIG. 6 is a top plan view of the tower of FIG. 5.
Figure 5:
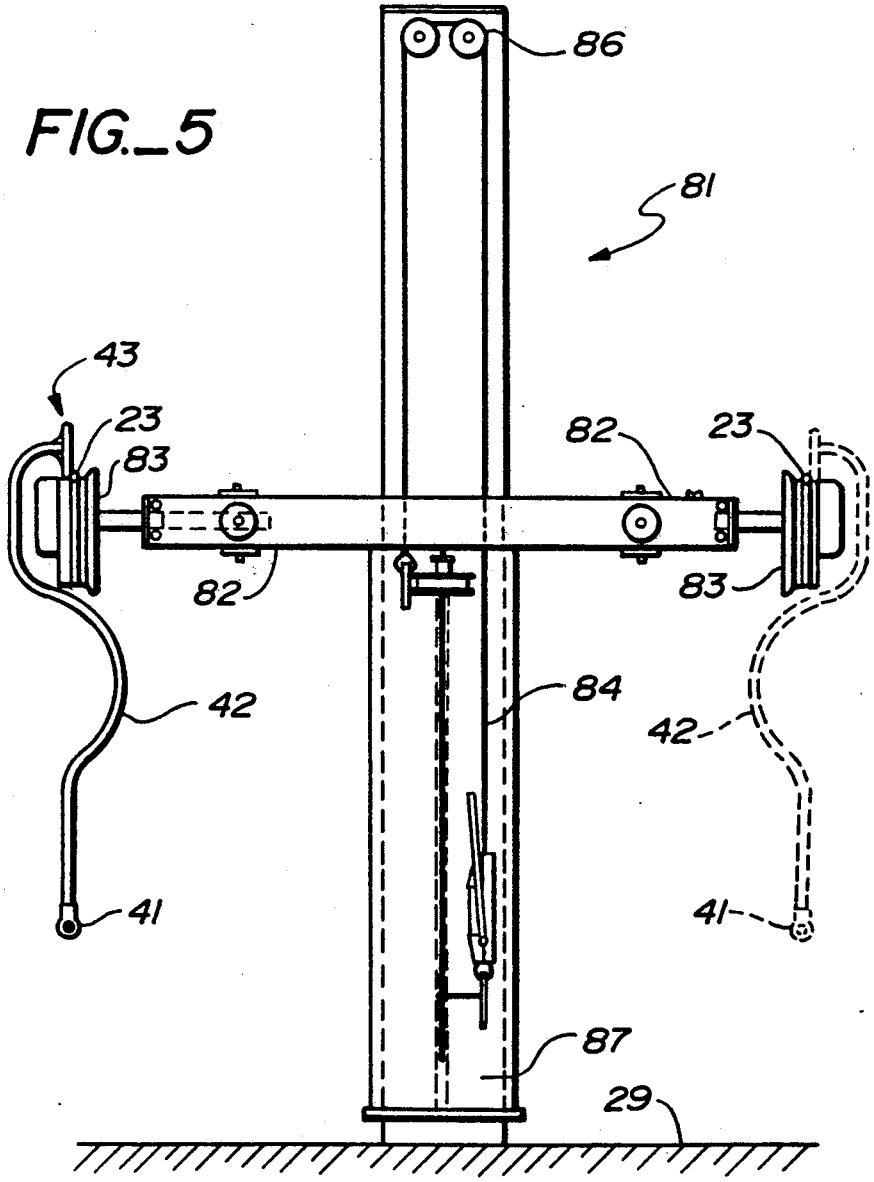
FIG. 5 is an end elevation view, in reduced scale, of an intermediate haul rope and tow rope support tower constructed in accordance with the present invention.

In FIGS. 5 and 6, an intermediate tower, generally designated 81, which is suitable for use in the rope tow system of the present invention is shown. Tower 81 can carry a vertically-adjustable cross-arm assembly 82 on the end of which are mounted haul rope support sheaves 83. In the illustrated intermediate tower, a cable 84 mounted over pulleys 86 can be used to raise and lower cross-bar 82 in order to obtain the proper spacing between tow rope 41 and the snow surface 29 along the tow path. As may best be seen in FIG. 6, in towers having sheave raising and lowering structures, ladders or the like on the outside of the tower, it is preferable that the base of the intermediate tower be formed with a V-shaped deflector 87, which can also have padding secured thereto.

As will be seen, therefore, the tow rope apparatus of the present invention is readily amenable to the use of intermediate support towers. This allows the tow rope to be maintained in an elevated condition with respect to the snow surface so that it does not drag on the snow surface and freeze or pick-up debris. The skiers can retain their grip of tow rope 41 while haul rope 23 is passing over the intermediate support towers without any danger or need to release the tow rope.

In order to further facilitate gripping of tow rope 41 hand grips 45 (FIGS. 1 and 2) can be attached to rope 41 intermediate hanger arms 42. Arms 42 obviously also provide a very convenient structure for the skier to grip. If two or more skiers grip a tow rope section between arms 42 there will be tension accumulation in that rope section, but since the number of skiers which can grip the tow rope between any two hanger arms is low, the tension increase will be relatively low.

Figure 7:
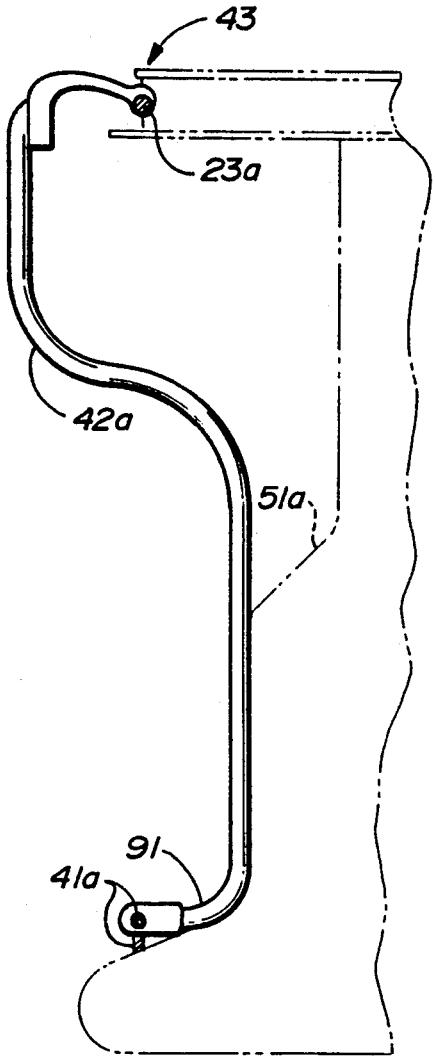
FIG. 7 is an end elevation view corresponding to FIG. 4 of an alternative embodiment of the rope tow system of the present invention.
Figure 8:
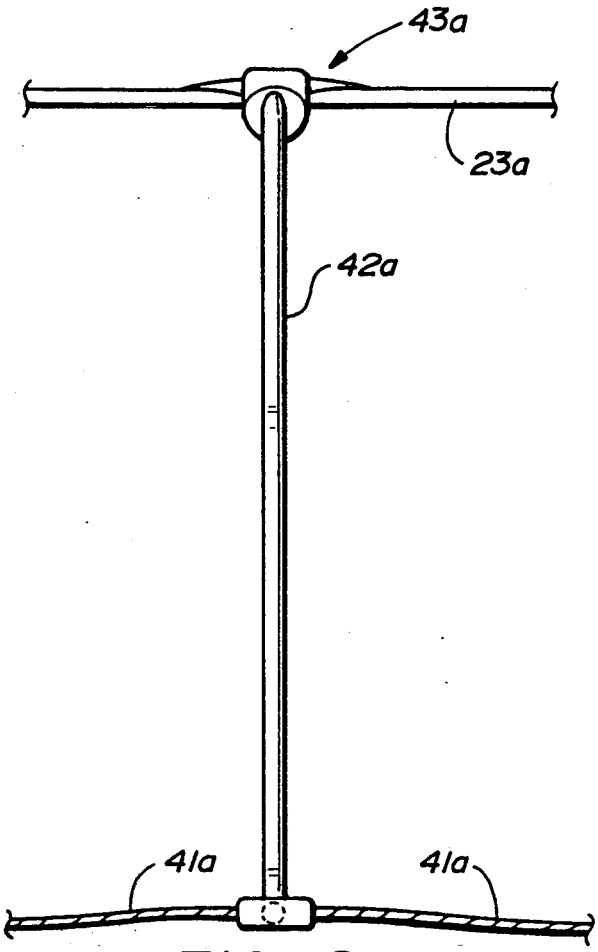
FIG. 8 is a side elevation view of the rope tow of FIG. 7.
Figure 9:
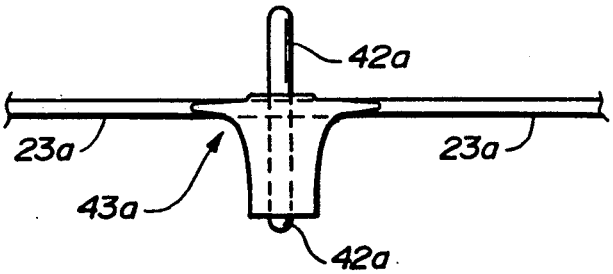
FIG. 9 is a top plan view of the rope tow of FIG. 7.

In FIGS. 7–9, an alternative embodiment of a rope tow constructed in accordance with the present invention is illustrated. Tow rope 41*a* is mounted to haul rope 23*a* by a hanger arm 42*a* which employs a chairlift-type cable grip assembly 43*a*. Grip assembly 43*a* has been modified from that of a standard chairlift grip assembly by welding or otherwise fixing hanger arm 42*a* so that it is not free to swing in fore and aft directions, as would be permitted in a chairlift hanger arm. A chairlift grip assembly 43*a* which has been found to be suitable for this purpose is the YAN No. 6 Grip Assembly manufactured by Lift Engineering and Manufacturing of Carson City, NV. This grip assembly, once secured against swinging, will be effective in substantially preventing aft deflection of the hanger arm, or substantial accumulation of tension forces in the tow rope.

As best may be seen in FIG. 7, the bull wheel tow rope support structure 51*a* and the lower end 91 of hanger arm 52*a* are cooperatively formed so that tow rope 41 is held out of contact with skirt 51*a* at the hanger arms. This allows a skier to hold onto the tow rope even while supported on skirt 51*a* without injury to the skier's hand.

One of the advantages of using a standard chairlift grip assembly 43*a* is that they are already designed to pass easily around bull wheels.

The method of the present invention provides a system for supporting a tow rope in a rope tow conveying assembly and a method of providing a tow rope system. The tow rope supporting method includes the steps of mounting a plurality of hanger arms 42 to a haul rope 23 supported for movement along a tow path. The mounting step is accomplished by relatively rigidly securing each hanger arm 42 to haul rope 23 against substantial deflection in an aft direction relative to advancement of the haul rope. Additionally, the method of supporting a tow rope includes the step of coupling of a user-grippable tow rope 41, 41*a* to hanger arms 42, 42*a* at positions below haul rope 23, 23*a*. This is usually accomplished by coupling the tow rope proximate the lower-most or distal ends of each hanger arm 42, 42*a*.

In the tow rope supporting method, the step of mounting hanger arms 42, 42*a* preferably is further accomplished by mounting hanger arms 42, 42*a* to haul rope 23, 23*a* which is to be placed under substantial axial tension during advancement, while the step of coupling tow rope 41, 41*a* to the hanger arms is accomplished by coupling the tow rope to the hanger arms with sections of tow rope between hanger arms 42, 42*a* under relatively insubstantial axial tension. Finally, the method includes mounting hanger arms 42, 42*a* in a manner securing them against deflection in a fore and an aft direction while permitting bending of haul rope 23, 23*a* and hanger arm mounting assembly 43, 43*a* in a horizontal plane transverse to the haul rope.

The method of providing a rope tow system of the present invention comprises the steps of supporting an endless haul rope 23, 23*a* on haul rope support means, such as bull wheels 21 and 22, for advancement of the haul rope along, and at a substantial distance above, a tow path. Additionally, the method includes the step of mounting a plurality of downwardly-depending hanger arms 42, 42*a* in spaced relation along haul rope 23 with the hanger arms each being secured to the haul rope against substantial displacement in an aft direction relative advancement of the haul rope. Finally, the method includes the step of coupling tow rope 41, 41*a* to hanger arms 42 in positions below the haul rope and at a height above the tow path enabling gripping engagement of the tow rope by skiers standing on the tow path.

What is claimed:

1. A top tow comprising:

a haul rope extending along a two path;

haul rope mounting means mounting said haul rope for movement in spaced relation above said tow path;

haul rope driving means coupled to said haul rope for advancement of said haul rope;

a plurality of hanger arms coupled to said haul rope and depending downwardly therefrom, said hanger arms each being coupled by hanger arm mounting means formed to and substantially preventing deflection of said hanger arms relative to said haul rope in a direction along said haul rope opposed to the direction of advancement of said haul rope; and a user-grippable tow rope coupled to said plurality of hanger arms, at positions below said haul rope and at a user level for users to directly grasp the tow rope, said hanger arm mounting means substantially preventing transfer of tension from a user grasped section of the two rope located between a pair of said hanger arms to an adjacent section of said tow rope located in advance of said user grasped section, said two rope advancing users by means of the users directly grasping the tow tope in motion.

2. The rope tow as defined in claim 1 wherein, said haul rope is an endless rope arranged in a loop extending along said two path;

said haul rope mounting means includes rope supporting sheave means positioned at opposite ends of said two path and movably supporting the looped haul rope; and said haul rope driving means includes a drive wheel frictionally engaging said haul rope.

3. The rope tow as defined in claim 1 wherein, said haul rope and said two rope are both endless ropes arranged in a loop extending along said two path.

4. The rope tow as defined in claim 3 wherein, said haul rope is mounted to said haul rope mounting means under substantial axial tension.

5. The rope tow as defined in claim 4 wherein, said tow rope is mounted between said hanger arms under insubstantial axial tension.

6. The rope tow as defined in claim 1 wherein,
said hanger arm mounting means relatively rigidly couple each of said hanger arms to said haul rope against deflection in both a fore and an aft direction along said haul rope.

7. The rope tow as defined in claim 1 wherein,
said haul rope driving means is provided by substantially horizontally oriented bull wheel means frictionally engaging said haul rope; and
said hanger arm mounting means is formed to pass around said bull wheel means.

8. The rope tow as defined in claim 7 wherein,
said hanger arm mounting means is formed for deflection laterally of said haul rope and is formed for passage around said bull wheel means.

9. The rope tow as defined in claim 8 wherein,
said hanger arm mounting means includes a plurality of haul rope gripping assemblies grippingly engaging said haul rope at spaced locations along said haul rope, a stiffening member extending along said haul rope and formed to resist bending about a horizontal axis perpendicular to said haul rope, said stiffening member being coupled rigidly to and between said gripping assemblies, and at least one of said hanger arms depending downwardly from at least one of said gripping assemblies.

10. The rope tow as defined in claim 9 wherein,
said stiffening member is provided by at least one thin metal plate oriented substantially in a vertical plane through said haul rope for resilient bending of said stiffening member transverse to said haul rope as said haul rope passes around said bull wheels.

11. The rope tow as defined in claim 10 wherein,
said hanger arm mounting means includes three rope gripping assemblies mounted to said haul rope in spaced apart relation therealong,
said stiffening member extends between and is rigidly secured to each of said gripping assemblies, and
said hanger arm member is rigidly coupled to a middle one of said gripping assemblies.

12. The rope tow as defined in claim 3 wherein,
said haul rope driving means and said haul rope mounting means include a horizontally oriented drive wheel frictionally engaging a loop end of said haul rope proximate one end of said tow path and a near horizontally oriented support wheel frictionally engaging an opposed loop end of said haul rope proximate an opposite end of said tow path.

13. The rope tow as defined in claim 12 wherein,
said drive wheel and said support wheel each carry downwardly a depending tow rope support structure formed for and supporting said tow rope in substantially parallel relation to said haul rope as said haul rope passes around said drive wheel and said support wheel.

14. The rope tow as defined in claim 13 wherein, said tow rope support structure includes a resiliently compressible surface proximate engagement with said tow rope.

15. The rope tow as defined in claim 13 wherein,
said tow rope support structure includes a cylindrical side wall positioned to engage said hanger arms over a substantial length thereof proximate and above coupling to said tow rope, and a lip portion tapering outwardly and downwardly from said cylindrical side wall below distal ends of said hanger arms to guide said tow rope intermediate said hanger arms.

16. A method of supporting a tow rope in a rope tow conveying assembly comprising the steps of:
mounting a plurality of hanger arms to a hula rope supported for movement along a tow path;
coupling a user-grippable tow rope to said plurality of hanger arms, at positions below said haul rope and at a user level for users to directly grasp the tow rope;
relatively rigidly securing each of said hanger arms to said haul rope against substantial transfer of tension from a user grasped section of the tow rope located between a pair of said hanger arms to an adjacent section of said tow rope located in advance of said user grasped section; and
whereby said tow rope advances users by way of the users directly grasping the tow rope in motion.

17. The method as defined in claim 16 wherein,
said mounting step is accomplished by mounting said hanger arms to a haul rope to be placed under substantial axial tension during advancement of said haul rope; and
said coupling step is accomplished by coupling said tow rope to said hanger arms in a manner that a section of said tow rope extending between each pair of said hanger arms has a length placing said tow rope under substantially no axial tension.

18. The method as defined in claim 17 wherein,
said securing step is accomplished by securing said hanger arms against substantial deflection relative to said haul rope in both fore and aft directions along said haul rope without preventing bending of said haul rope in a horizontal plane transverse to said haul rope.

19. A method of providing a rope tow system comprising the steps of:
supporting an endless haul rope on haul rope support means for advancement of said haul rope along and a substantial distance above a tow path;
mounting a plurality of downwardly depending hanger arms in spaced apart relation along said haul rope;
coupling an endless tow rope to said hanger arms at positions below said haul rope and at a skier level for a skier standing on said tow path to directly grasp the tow rope;
securing each of said hanger arms to said haul rope against substantial displacement in fore and aft directions relative to said haul rope to substantially prevent transfer of tension from a skier grasped section of the tow rope located between a pair of said hanger arms to adjacent sections of said tow rope located fore and aft of said skier grasped section; and
whereby said tow rope advances skiers by means of the skiers directly grasping the tow rope in motion.

20. The method as defined in claim 19 and the step of:
advancing said haul rope while under substantial axial tension along said tow path to advance skiers gripping said tow rope.

21. The method as defined in claim 20 wherein,
said coupling step is accomplished by coupling a length of two rope to said hanger arms, said length of tow rope being sufficiently longer than said haul rope between said hanger arms such that said tow rope is in a relatively relaxed condition between said hanger arms when id haul rope is in a highly tensioned condition during said advancing step.

* * * * *

UNITED STATES PATENT AND TRADEMARK OFFICE

CERTIFICATE OF CORRECTION

PATENT NO. : 5,193,463

DATED : March 16, 1993

INVENTOR(S) : Jan K. Kunczynski

It is certified that error appears in the above-identified patent and that said Letters Patent is hereby corrected as shown below:

Column 8, Claim 1, line 25, delete "two" and insert therefor ---tow---.

Column 8, Claim 1, line 44", delete "two" and insert therefor ---tow---.

Column 8, Claim 1, line 47, delete "two" and insert therefor ---tow---.

Column 8, Claim 2, line 52, delete "two" and insert therefor ---tow---.

Column 8, Claim 2, line 55, delete "two" and insert therefor ---tow---.

Column 8, Claim 3, line 60, delete "two" and insert therefor ---tow---.

Column 8, Claim 3, line 61, delete "two" and insert therefor ---tow---.

Column 10, Claim 16, line 3, delete "hula" and insert therefor --haul--.

Column 10, Claim 21, line 62, delete "two" and insert therefor ---tow---.

UNITED STATES PATENT AND TRADEMARK OFFICE

CERTIFICATE OF CORRECTION

PATENT NO. : 5,193,463

DATED : March 16, 1993

INVENTOR(S) : Jan K. Kunczynski

It is certified that error appears in the above-indentified patent and that said Letters Patent is hereby corrected as shown below:

Column 10, Claim 21, line 66,
delete "id" and insert therefor ---said---.

Signed and Sealed this

Sixteenth Day of November, 1993

*Attest:*

Bruce Lehman

BRUCE LEHMAN

*Attesting Officer*

*Commissioner of Patents and Trademarks*